US005451968A

United States Patent [19]

Emery

[11] Patent Number: 5,451,968

[45] Date of Patent: Sep. 19, 1995

[54] CAPACITIVELY COUPLED HIGH FREQUENCY, BROAD-BAND ANTENNA

[75] Inventor: William M. Emery, Toledo, Ohio

[73] Assignee: Solar Conversion Corp., Holland, Ohio

[21] Appl. No.: 214,543

[22] Filed: Mar. 18, 1994

Related U.S. Application Data

[63] Continuation-in-part of Ser. No. 978,715, Nov. 19, 1992.

[51] Int. Cl.[6] ..... H01Q 9/00

[52] U.S. Cl. ..... 343/749; 343/878; 343/888; 343/900

[58] Field of Search ..... 343/715, 722, 749, 750, 343/878, 888, 900; H01Q 9/00

[56] References Cited

U.S. PATENT DOCUMENTS

| | | | |
|---|---|---|---|
| 2,964,746 | 12/1960 | Trudnak et al. | 343/749 X |
| 3,264,647 | 8/1966 | Nuttle | 343/900 X |
| 3,408,652 | 10/1968 | Allisbaugh | 343/715 |
| 3,747,112 | 7/1973 | Hidaka | 343/749 |
| 4,115,783 | 9/1978 | Reggia | 343/830 X |
| 4,200,874 | 4/1980 | Harada | 343/715 |
| 4,238,800 | 12/1980 | Newington | 343/715 |
| 4,749,999 | 6/1988 | Hayashi | 343/715 X |
| 4,804,973 | 2/1989 | Ackman | 343/88 |

FOREIGN PATENT DOCUMENTS

| | | | |
|---|---|---|---|
| 2148604 | 5/1985 | United Kingdom | 343/900 |

*Primary Examiner*—Donald Hajec
*Assistant Examiner*—Steven Wigmore
*Attorney, Agent, or Firm*—William P. Hickey

[57] ABSTRACT

A capacitively coupled high frequency broad-band antenna comprising a stub having a tubularly shaped lower end that is capacitively coupled to a first terminal element for the center conductor of a transmission line. The outer conductor of the transmission line is connected to a base support element which is accurately spaced from the first terminal element by a dielectric spacer element; and the three elements are encapsulated and hermetically sealed by a plastic molded housing.

5 Claims, 2 Drawing Sheets

CAPACITIVELY COUPLED HIGH FREQUENCY, BROAD-BAND ANTENNA

The present application is a Continuation in part of my similarly entitled copending application Ser. No. 978,715 filed Nov. 19, 1992.

TECHNICAL FIELD

The present invention relates to high frequency broad-band antennas; and more particularly to stub antennas for such frequencies capable of a broad band pass.

BACKGROUND OF THE INVENTION

Whip and stub antennas of the type with which we are concerned are relatively small and are capable of shipping in light weight packages. Currently such items are being made abroad in countries where labor is cheap and are being shipped into this country almost with impunity. High frequency whip antennas that are currently commercially available are short whips having a standing wave ratio of 2 to 1 over a band pass of 50 MHZ above and below the design frequency. With the explosion that has occurred in the telecommunication art with cellular telephones, CB'S, ham radios, etc. the channels within a band width have become increasingly crowded, thus making it necessary that the antenna work acceptably well over all the channels in a band. In addition, the competition requires that an antenna manufacturer produce antennas for a number of band frequencies as cheaply as possible to offset the advantage that is had by cheap foreign labor.

An object of the present invention therefore is the production of a high frequency monopole antenna having a standing wave ratio of no more than 2 to 1 over a band width of from approximately 700 MHZ to 1000 MHZ.

Another object of the invention is the provision of a new and improved monopole antenna of the above described type which comprises a minimum of rugged parts whose dimensions can be changed within the envelope of a single injection molding cavity for its housing, to give antennas designed for a number of government specified bands ranging from 120 MHZ to 3000 MHZ.

Another object of the invention is the provision of a new and improved antenna of the above described type which can serve as either a half wave antenna or a quarter wave antenna so that the same size structure can be used effectively for frequencies much lower than possible for a half wave antenna of the same size.

A further object of the invention is the provision of an antenna of the above described type which needs no tuning after it leaves the molding machine in order to center on the design frequency.

Further objects and advantages of the invention will become apparent to those skilled in the art to which the invention relates from the following description of the preferred embodiments described with reference to the accompanying drawings forming a part of this specification.

BRIEF SUMMARY OF THE INVENTION

In order to achieve the objects of the invention, the structural parts of the antenna are designed to perform a dual function, namely to be not only the supporting structure of the antenna, but its electrical components as well.

The invention comprises a unique combination of parts which allows the parts to perform a combination of functions and which greatly reduces the number of parts necessary. While conventional antennas are fed by an impedance matching network that is fed by one conductor of a transmission line while the other conductor is connected to ground, the present invention eliminates such a network. One structure of the present invention comprises a lower automatic screw machine part and an upper automatic screw machine part spaced axially apart and secured together by molded plastic in a manner allowing the upper and lower screw machine parts to protrude from the molded plastic. The lower end of the lower screw machine part is used as a connection to support the molded part, and the protruding upper end of the upper part serves the function of supporting the monopole of the antenna. The two screw machine parts are spaced apart and held together by the molded plastic, with one transmission conductor being connected to one screw machine part, and the other conductor being connected to the other screw machine part. Further aspects of the invention are achieved by a uniquely configured monopole that is connected to the upper screw machine part.

DESCRIPTION OF THE PREFERRED EMBODIMENTS

Figure 1:
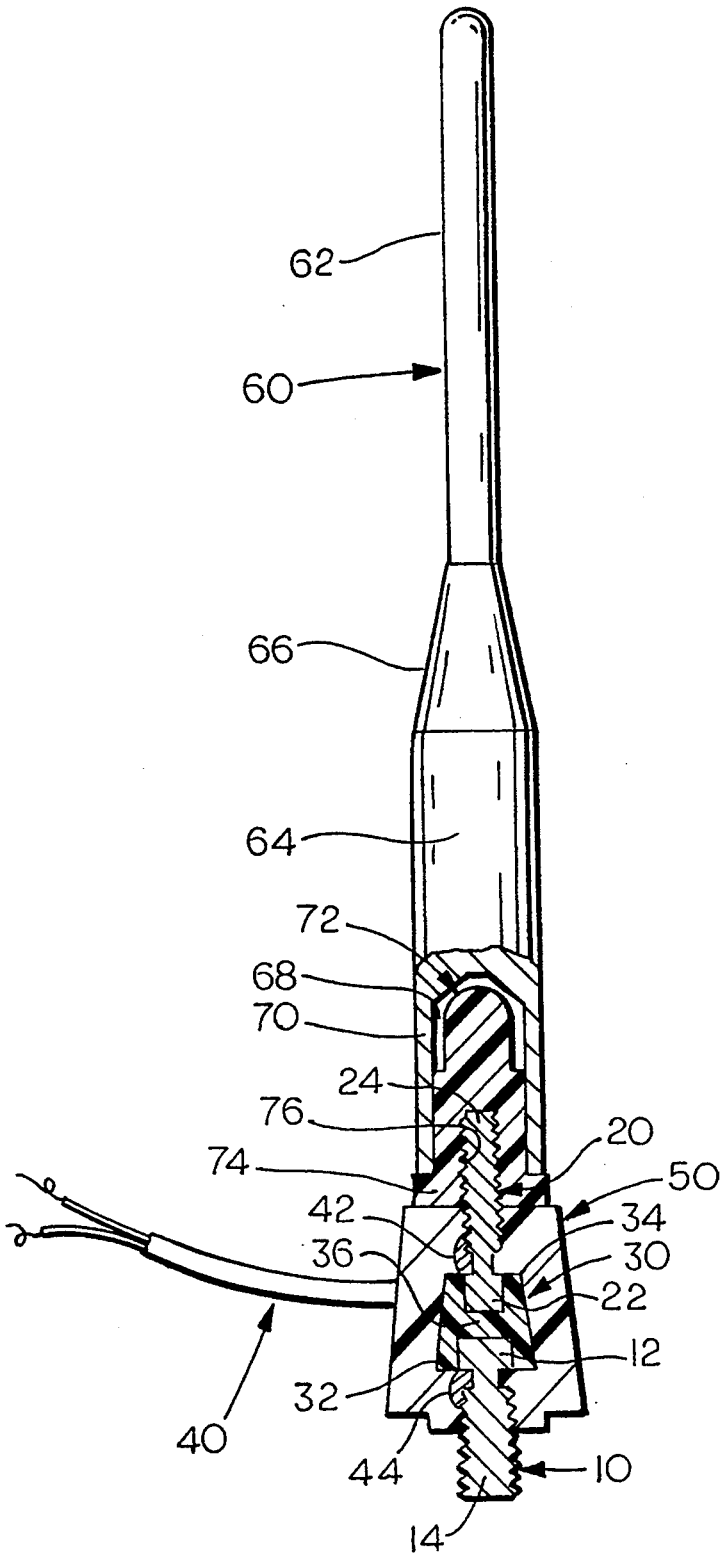
FIG. 1 of the drawings is a longitudinal view with parts in section to better show the arrangement of parts and showing a double cup-shaped plastic part between the screw machine parts as it exists before the heat of the molding machine fuses it with the plastic body of the antenna.

As previously indicated, the invention utilizes a lower support element 10, and an upper whip support element 20 which are spaced apart and axially aligned. The lower base support element 10 has a cylindrical upper end 12, and a lower threaded end 14. The upper whip support element 20 has a lower cylindrical end 22, and an upper threaded end 24. The elements 10 and 20 are held spaced apart by a double cup-shaped dielectric spacer 30 having a lower tubular section 32 which surrounds the upper end 12 of the support element 10, and an upper tubular section 34 which surrounds the cylindrical end 22 of the whip support element 20. The spacer 30 also has a midsection wall 36 of an accurate thickness to space the elements 10 and 20 a precise distance apart.

The ends of a two conductor transmission line 40 are soldered to the elements with the center conductor 42 being soldered to the whip support element 20 just above the double cupped dielectric spacer 30, and the with the of outer conductor 44 being soldered to the support element 10 just below the double cup-shaped spacer element 30. The respective threaded ends 14 and 24 are inserted into receiving holes of an injection molding machine, not shown, and a plastic body 50 of dielectric material is injection molded around the elements 10, 20, and 30. The body 50 thus formed may be of a different plastic from that of the spacer element 30, or may be of the same plastic as the spacer 30. In the later case, the spacer 30 will fuse integrally with the body material 50 so as to become integral therewith.

The assembly so far described lends itself to simple attachment to a monopole 60 having an upper section 62 of small diameter and a lower section 64 of larger diameter. It has been found that the use of two different diameters provides a monopole capable of a wide band pass. ace.

I have discovered that a conical intermediate or midsection 66 between the small diameter upper section 62 and the larger diameter lower section 64 helps increase the width of the band pass without causing the signal to project upwardly. The signal of the three diameter section monopole is essentially horizontal.

The lower end of the monopole has a cylindrical chamber 68 therein to form tubular side walls 70 that are spaced apart from the upper end 24 of the whip support element 20. This spacing is accurately maintained by a hat-shaped dielectric spacer element 72 that is cemented into the chamber 68. Spacer 72 has a flange 74 a precise thickness to bear against the end of the tubular side walls 70 and space them from the body 50. The hat-shaped spacer 72 has an axially extending threaded opening 76 therein for threaded engagement by the threaded upper end 24 of the whip support element 20.

In a preferred embodiment of the invention, the wall 36 has a thickness of 0.070 inch, the cylindrical section 12 has a diameter of 0.250 inch, and the cylindrical section 22 has a diameter of 0.180 inch. This arrangement gives an impedance match of 50 ohms for the transmission line. The diameter of the antenna section 64 is 0.375 inch, the cylindrical chamber 68 has a diameter of 0.300 inch, and the section 62 has a diameter of 0.180 inch. This gives a half wave antenna centered at 850 MHZ and a band pass of from 700 to 1000 kMHZ within a standing wave ratio of under 2.0. All of the antennas produced have a frequency centered on 850 MHZ without individual adjustment after assembly.

It is found that the parts of the configuration can be changed without changing the dimensions of the monopole 60, or the injection mold cavity, to produce antennas handling a frequency as low as 120 and as high as 3000 MHZ. It has also been found that for the lower frequencies, the antenna can be used as a voltage fed quarter wave antenna, while for the higher frequencies, it is used as a voltage fed half wave antenna. In addition, the capacitance between the tubular walls 70 and the upper section 24 of the monopole support element 20, can be adjusted to give the desired electrical length to the monopole for the higher frequencies.

All in all, the invention gives a very simple rugged and versatile construction that is efficient over a broad band width, that does not need individual tuning, and which can be very economically changed to give antennas for a number of different broadcast bands. It will also be seen that the solder connections of the conductors 42 and 44 to the elements 20 and 10 respectively, keep the parts 20 and 10 firmly anchored in the plastic body 50.

Figure 2:
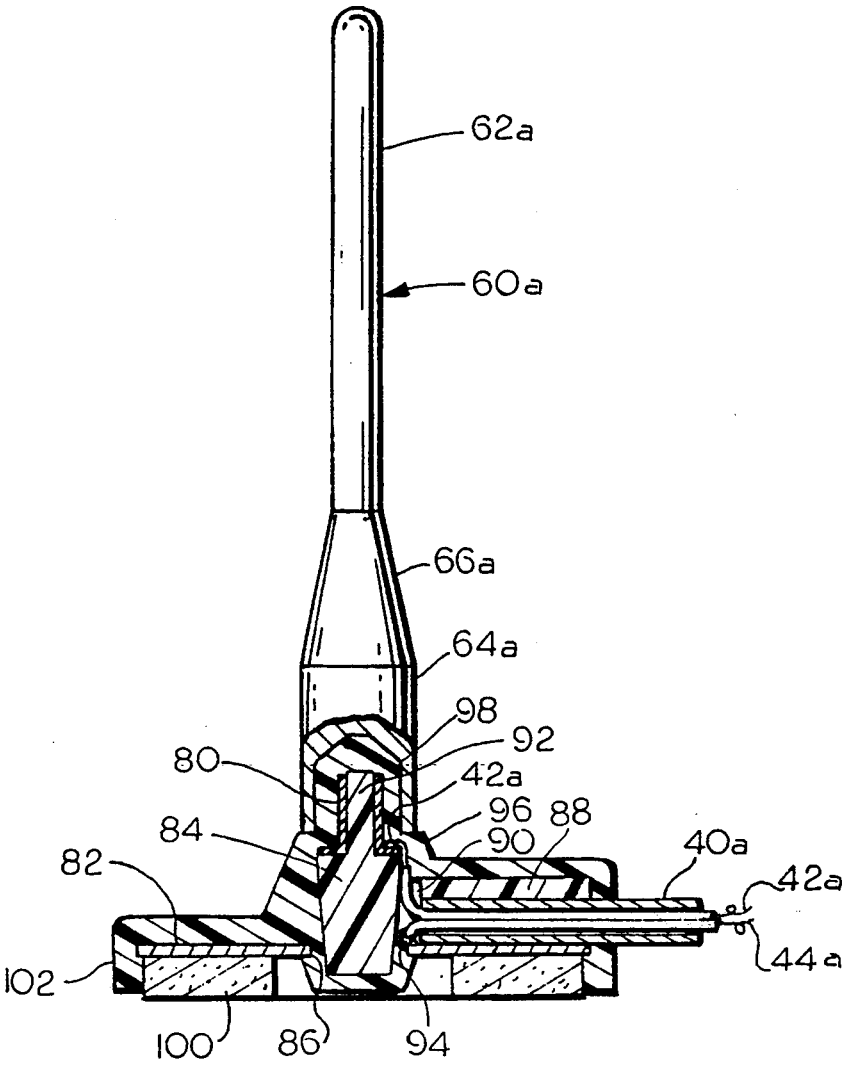
FIG. 2 of the drawings is a longitudinal view, similar to FIG. 1, and having portions sectioned to better show the internal structure of a second embodiment of the invention.
Figure 3:
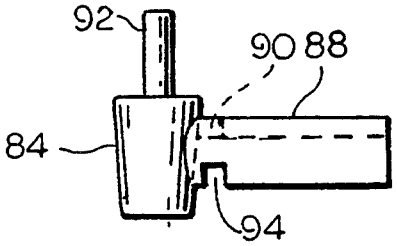
FIG. 3 is a side elevational view of a capacitor element support seen sectioned in FIG. 2.
Figure 4:
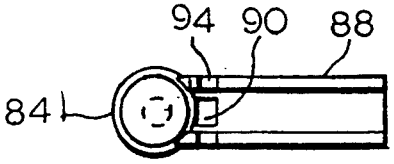
FIG. 4 is a bottom view of the capacitor element support shown in FIG. 3.

The embodiment shown in FIGS. 2 through 4, differs principally from the embodiment shown in FIG. 1 in the way the capacitive coupling to the antenna is achieved; the way that the transmission lines are attached thereto; and the way the unit is attached to a supporting structure. Those portions of FIGS. 2 through 4 which are similar to corresponding portions of the embodiment of FIG. 1 are designated by a like reference numeral characterized further in that a suffix "a" is affixed thereto. In the embodiment shown in FIGS. 2 through 4, the tubular ferrule 80 takes the place of the upper whip support element 20; the annular base support plate 82 takes the place of the lower support element 10; and the dielectric spacer 84 takes the place of the double cup shaped spacer 30 of FIG. 1.

The annular plate 82 has a central opening 86 therethrough through which the lower end of the dielectric spacer 84 extends. The dielectric spacer 84 has a side tunnel portion 88 through which the two conductor transmission cable **40*a* extends. The center conductor 42*a* passes through an opening 90 in the top of the inner end of the tunnel portion 88 and is soldered to the lower end of the tubular ferrule 80. The reduced diameter upper end 92 of the spacer 84 receives the tubular ferrule 80 and accurately positions it from the annular plate 82 and the lower section 64*a* of the monopole 60*a*. The outer conductor 44*a* extends laterally through a side opening 94 of the side tunnel portion 88 and is soldered to the top of the annular plate 82. After soldering the above described assembly, it is put in an injection molding machine and the upper exposed surfaces of the assembly are encased in a plastic housing 96**.

The upper end of the plastic housing 96 has a reduced diameter section 98 over which the lower end of the tubular lower section **64*a* of the monople 60*a* is adhered. It will be seen that the plastic housing 96 heremetically seals the ferrule 80 and the soldered connections to it, as well as the base plate 82, and accurately positions the ferrule 80 for capacitive coupling with the base plate 82, and the lower end of the monopole 60*a*. An annular magnetic ring 100 is adhered to the bottom of the base plate 82 inside of a tubular extension 102 of the plastic housing 96** for magnetically attaching the antenna to metal objects such as automotive vehicles.

It will now be seen that the embodiment shown in FIGS. 2 through 4 produces, among other things, a simplification over the embodiment slown in FIG. 1, by combining the elements 50 and 72 into a single molded part.

While the invention has been described in considerable detail, I do no wish to be limited to the particular embodiments shown and described; and it is my intention to cover hereby all novel adaptations, modification, and arrangements thereof which come within the practice of those skilled in the art to which the invention relates and which come within the purview of the following claims.

I claim:

1. An antenna having a capacitive drive assembly comprising; an electrically conductive base support element; an electrically conductive whip support element spaced apart from and coaxially aligned with said base support element; a double cup-shaped dielectric member having upper and lower oppositely extending generally tubular sections, and a midsection transverse wall separating said tubular sections, said lower extending tubular section receiving the upper end of said whip support element; said midsection transverse wall accurately spacing said whip support element from said base support element and being of a thickness providing precise capacitive coupling between said whip element and support element; a plastic body surrounding and bonded to said double cup-shaped dielectric member and portions of said base support and whip support elements to structurally secure the elements together, and with respective opposite ends of said base support element and whip support element projecting therefrom; a two conductor transmission line having one conductor connected to said whip support element and the other conductor connected to said base support element; and an antenna element having a lower tubular end section surrounding and spaced apart from said whip support element to be capacitively coupled therewith.

2. A capacitively driven RF antenna having a longitudinally extending centerline and comprising: an electrically conductive base support; a dielectric preformed spacer having first and second precisely spaced abutment surfaces, said first abutment surface bearing against said base support; a first electrically conductive capacitive element forming a plate of a capacitor bearing against said second abutment surface of said spacer; a dielectric structure surrounding said first capacitive element and portions of said base support element to structurally secure the element in precise spacial relationship to said base support, said dielectric structure providing a third abutment surface which is precisely spaced from said first capacitive element; a two conductor transmission line having one conductor connected to said first element in such manner as to transmit the RF signal of the antenna, and the other conductor connected to said base support; and an electrically conductive antenna having a tubular lower end accurately positioned relative to said first capacitive element by said third abutment surface to provide a second capacitive element which couples with said first capacitive element for transmitting the RF signal of the antenna.

3. A capacitively driven RF antenna having a longitudinally extending centerline and comprising: an electrically conductive base support; a dielectric preformed spacer having first and second precisely spaced abutment surfaces, said first abutment surface bearing against said base support; a first electrically conductive capacitive element forming a plate of a capacitor bearing against said second abutment surface of said spacer; an antenna stub having three distinct radiating sections that include an upper small diameter section, a lower larger diameter section, and an intermediate conically shaped midsection joining the upper and lower sections, said lower larger diameter section having a tubular lower end wall which forms a second capacitive element of said capacitor to transmit the RF signal; and a dielectric body covering said base support with an upper cylindrical end portion covering and precisely spacing said first capacitive element from said second capacitive element and from said base support to support said stub, and whereby a rigid precisely tuned antenna structure is provided.

4. A capacitively driven antenna comprising: an electrically conductive base support; a dielectric preformed spacer having first and second precisely spaced abutment surfaces, said first abutment surface bearing against said base support; a first electrically conductive capacitive element bearing against said second abutment surface of said spacer and forming one element of a capacitor; a plastic structure surrounding and bonded to said dielectric spacer and portions of said base support and first capacitive element to structurally secure the elements together; a two conductor transmission line having a first conductor connected to said first capacitive element and a second conductor connected to said base support; and an antenna stub having a tubular lower end wall which forms the second element of said capacitor, said plastic structure having a cylindrical abutment surface precisely spaced from said first capacitive element, said cylindrical abutment surface tightly receiving said tubular lower end wall of said stub to simultaneously support said stub and provide a predetermined capacitive coupling through which the RF signal is transmitted to said first conductor.

5. A broad band antenna comprising: a one piece electrically conductive stub having three integral and distinct sections comprising; an upper small diameter section, a lower larger diameter section of a length approximately that of said upper small diameter section, and an intermediate conically shaped midsection joining the upper and lower sections, said lower larger diameter section having a tubular lower end wall constructed and arranged to form a first element forming a plate of a capacitor; a plastic structure within said tubular end wall and tightly supporting said stub; and a second electrically conductive capacitor element within said plastic structure opposite said tubular lower end wall and precisely spaced therefrom to complete said capacitor and provide a precise predetermined capacitive coupling for RF signal transmission between said stub and second capacitor element.

* * * * *